United States Patent [19]

Radek et al.

[11] Patent Number: 4,674,231

[45] Date of Patent: Jun. 23, 1987

[54] MAGNETIC DOOR OPENER

[75] Inventors: John R. Radek, Hinsdale; Richard Maks; Russell Vestuto, both of Chicago, all of Ill.

[73] Assignee: Ready Metal Manufacturing Company, Chicago, Ill.

[21] Appl. No.: 859,078

[22] Filed: May 2, 1986

[51] Int. Cl.[4] ..... E05C 7/06

[52] U.S. Cl. ..... 49/118; 49/123; 49/360; 49/409

[58] Field of Search ..... 49/123, 118, 360, 409

[56] References Cited

U.S. PATENT DOCUMENTS

| | | | |
|---|---|---|---|
| 1,232,439 | 7/1917 | Spitzfaden | 49/123 |
| 1,508,270 | 9/1924 | Connelly | 49/123 X |
| 1,594,513 | 8/1926 | Ainsworth | 49/118 X |
| 3,346,993 | 10/1967 | Johnson | 49/409 |
| 3,890,744 | 6/1975 | Galis | 49/360 |
| 4,090,265 | 5/1978 | Baus | 49/409 X |

FOREIGN PATENT DOCUMENTS

| | | | |
|---|---|---|---|
| 1131553 | 6/1962 | Fed. Rep. of Germany | 49/118 |

*Primary Examiner*—Philip C. Kannan

*Attorney, Agent, or Firm*—Balogh, Kramer, Dvorak, Genova & Traub

[57] ABSTRACT

A magnetic door opener device adapted to be positioned below a countertop made of non-magnetic materials, the device having a pair of magnets which attractively interact with a pair of magnets attached to the bottoms of a pair of windows which are suspended on a trolley for movement to or fro to determine closed and opened positions of the window. The device underneath the countertop comprises a pair of spaced toothed sprockets supporting an endless belt having inner and outer runs, the outer run supporting a magnet adapted to magnetically cooperate with a magnet in the bottom of one of the windows, and the other run of the belt supporting a different magnet adapted to attractively cooperate with a magnet in the bottom of the other window. A motor control and limit switches are provided for controlling the opening and closing positions of the windows when a control switch is operated by an operator. The belt has a plurality of apertures which, in conjunction with the teeth on the sprockets, prevent slippage and at the same time provide a means for adjustably positioning the magnets on the endless belt to thereby determine the size of the opening between the opened windows.

6 Claims, 3 Drawing Figures

FIG. 1
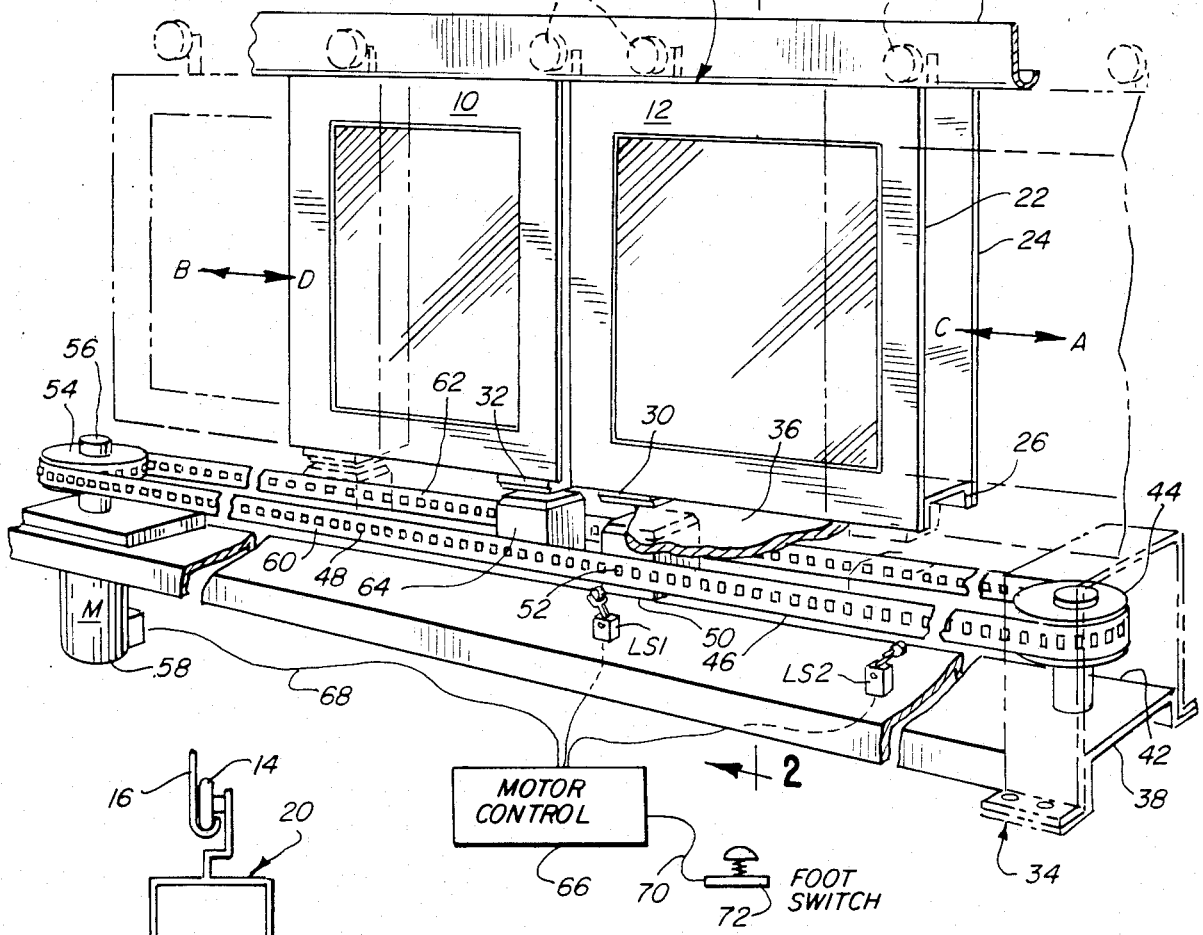
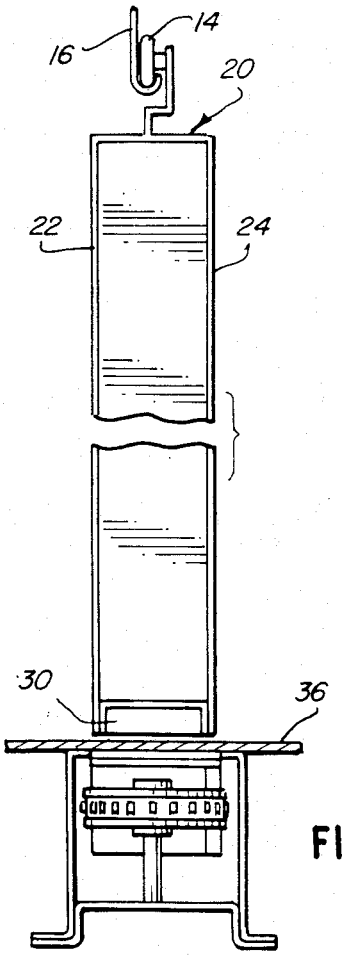
FIG. 2
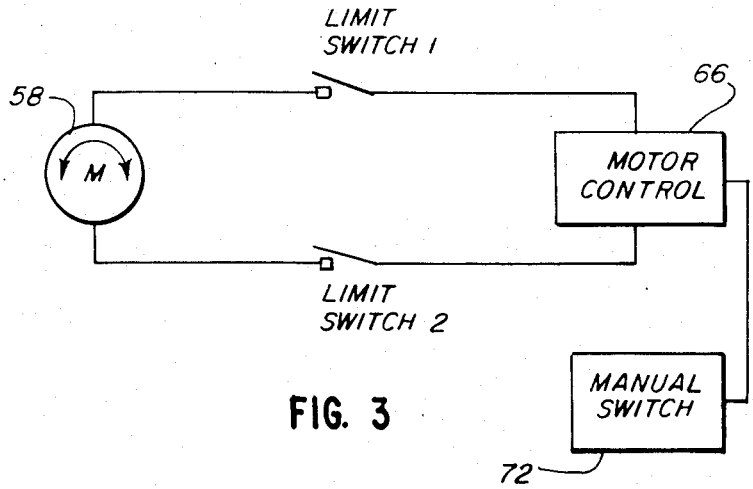
FIG. 3

MAGNETIC DOOR OPENER

BACKGROUND OF THE INVENTION

1. Field of the Invention

This invention is generally concerned with devices for controlling the opening and closing of doors, and more particularly is concerned with an apparatus for opening and closing windows incorporated in a wall structure.

2. Description of the Prior Art

Although there are many devices on the market for opening doors or windows, none of them are suitable for controlling the opening and closing of windows incorporated in a wall structure of a drive-in fast food restaurant.

SUMMARY OF THE INVENTION

The primary object of the invention is to provide a device for controlling the opening and closing of a pair of windows suspended on a trolley.

A further object of the invention is to provide a device for magnetically applying an attractive force to a pair of windows suspended on a trolley.

A still further object of the invention is to provide a system for controlling the operation of the opening and closing of a pair of windows.

All of the foregoing features are provided in a system wherein a pair of windows are movably supported on a trolley and guided at the bottoms thereof by guide rails, the bottoms of the windows being provided with magnetic pads which bearly clear the surface of a countertop made of non-magnetic material. Beneath the countertop, there is provided an apparatus for controlling the opening and closing of the two windows by a pair of magnetic pads positioned underneath the countertop and adapted to interact with the magnetic pads on the windows. The magnetic pads underneath the countertop are adjustably positioned on an apertured drive belt drivingly supported by a pair of spaced pulleys, one of which is driven directly by a motor. The drive system is provided with limit switches which can be adjustably mounted on a support bracket. The limit switches are incorporated with a motor control and a control switch which can be actuated by an operator to initiate the opening and subsequent closing of the windows.

BRIEF DESCRIPTION OF THE DRAWINGS

FIG. 1 is a perspective view of a control apparatus for operating the opening and closing a pair of windows;

FIG. 2 is a side view of the apparatus shown in FIG. 1; and

FIG. 3 is a diagrammatic illustration of a control circuit.

DESCRIPTION OF THE PREFERRED EMBODIMENT

Referring to FIGS. 1 and 2, there is shown a pair of windows provided with a plurality of rollers 14 movingly supporting the windows on a trolley 16 attached to a wall structure 18 which has an opening therein desired to be closed off by the pair of windows 10 and 12.

Each window, for example window 12, has a frame 20 having a pair of spaced inner and outer walls 22 and 24, respectively. The bottom of the window 12 defines a groove 26 which is adapted to receive a magnetic pad

30 which has a width which is slightly less than one-half of the width of the groove 26, as best shown in FIG. 2. On the other hand, the window 10 has a magnetic pad 32 which would occupy a position as shown in FIG. 2, as will now be described in detail.

The bottoms of the magnetic pads 30 and 32 barely clear the surface of a non-magnetic countertop 36. Beneath the countertop 36, these is located a magnetic drive device 34 which comprises a support member 38 longitudinally positioned below the windows 10 and 12. The support member 38 is adapted to be secured by a bracket 40 to the underside of the countertop 36, only one bracket being shown for clarity purpose. The support member has at one end 42, a toothed sprocket 44 rotatably supported and engaging an endless apertured belt 46 having a plurality of apertures 18 which serve a dual function of engaging with the teeth on the sprocket 44 and at the same time providing a means for attaching a lower magnetic pad which has a pair of nibs 52 engaging adjoining apertures of the belt 46. The other extent of the endless belt 46 is positioned on a similar toothed sprocket 54 secured on a shaft 56 of a motor 58 mounted below the support member 38. The belt 46 has an inner run 60 and an outer run 62. As shown in FIG. 1, the magnetic pad 50 is attached to the inner run 60 while a lower magnetic pad 64 is secured by its nibs (not capable of being seen) to the outer run 62. Therefore, as shown in FIG. 1, the magnetic pad 32 of the window 10 is associated with a lower magnetic pad 64 which is supported on the outer run of the belt 46, while the magnetic pad 30 of the window 12 is associated with a lower magnetic pad 50 secured by the nibs 52 to the inner run of the belt 46.

On top of the support member 38, there are adjustably positioned limit switches LS-1 and LS-2, both of the foregoing defining the extent that the windows can be opened and closed. The limit switches LS-1 and LS-2 are connected to a motor control 66 which is connected by a lead 68 to the motor 58 and by a lead 70 to a control switch 72.

Referring to FIG. 1, the windows 10 and 12 are shown in solid lines indicating a closed position. When it is desired to open the windows 10 and 12, the control switch 72 is actuated by an operator to provide a signal to the motor control 66 which will energize the motor 58 causing the motor shaft 56 to operate in a counterclockwise rotation. As a result, the inner run 60 of the belt 46 will move from the sprocket 54 to the sprocket 44 causing the lower magnetic pad 50, to move the window 12 in the direction of the arrow A. Simultaneously, a similar magnetic force is applied to the window 10 when the outer run 62 of the belt 16 moves from the sprocket 44 toward the sprocket 54, thereby moving the lower magnetic pad 64 and its associated attracted magnetic pad 32 to thereby move the window 10 in the direction of the arrow B. When the lower magnetic pad 50 reaches the position of the limit switch LS-2, it trips the switch, which then sends a signal to the motor control 66 to stop ener8izing the motor 58.

After a customer is served through the opened windows, the operator actuates the control switch 72 which sends a signal to the motor control 66, which then energizes the motor 58. At this time, the motor 58 and its shaft 56 will rotate in a clockwise direction causing the lower magnetic pad 50 to move away from the limit switch LS-2 and proceed toward the limit switch LS-1 which, upon being tripped by the lower magnetic pad 50, will send a signal to the motor control 66 to deactivate the motor 58. During this time, the window 12 will move in the direction of the arrow C, and the window 10 will move in the direction of the arrow head D.

Since the lower magnetic pad 50 is supported on the belt 46 by means of the nibs 52 and the apertures 48, the location of the lower magnetic pad 50 may be changed with respect to the belt 46 to thereby vary the opening of the windows 10 and 12.

The arrangement of the window with respect to sprockets 11, 54 and motor 58 may be such that they are disposed outwardly of the windows, when the windows are in the open position, contrary to the position shown in the drawing.

The upper surfaces of the lower magnetic pads 50 and 64 are positioned to be barely below the lower surface of the countertop 36. However, no harm will be created if the upper surfaces of the lower magnetic pads 50 and 64, as well as the lower surfaces of the magnetic pads 30 and 32, come in contact with surface of the non-magnetic countertop 36. Preferably, the countertop 36 is made from stainless steel, which will not interfere with the attraction existing between the spaced upper and lower magnetic pads.

Obviously, many modifications and variations of the present invention are possible in the light of the above teachings. It is, therefore, to be understood that, within the scope of the appended claims, the invention may be practiced otherwise than as specifically described.

What is claimed is:

1. A device for controlling operation of a pair of windows suspended by a trolley and adapted to be moved to and fro, above a coutertop comprising a magnetic pad secured to the bottom of each window and positioned above the top surface of the countertop, and magnetic means disposed below said countertop and adapted to coact with said magnetic pads for opening and closing said windows and control means for controlling the actuation of said magnetic means, wherein said magnetic means comprises a longitudinal support member, a sprocket rotatably supported at each end of said support member, and endless belt extending across said sprockets, a plurality of lower magnetic pads supported on said belt, each of said lower magnetic pads being disposed below a respective window magnetic pad, a motor for driving one of said sprockets, and brackets for securing said support member underneath said countertop.

2. A device according to claim 1, wherein said control means includes a motor control, a pair of spaced limit switches mounted on said support member along a path travelled by said endless belt, means connecting a motor and said limit switches to said motor control and a control switch connected to said motor control for initiating the operation of said motor control, whereby, upon limitation, the motor is energized to move the lower magnetic pads and the attracted window magnetic parts to effect opening and closing of said windows.

3. A device according to claim 2, wherein the limit switches are spaced along the travel path of one of the lower magnetic pads.

4. A device according to claim 1, wherein the bottom of each window is provided with a longitudinally extending groove, both of said grooves defining an elongated channel defined by a pair of spaced walls of each window, one of said window magnetic pads being located adjacent one of said walls of one window while the other window magnetic pad is located adjacent the other wall of the other window.

5. A device according to claim 1, wherein said belt has a plurality of spaced apertures extending along the length of said belt, said sprockets being provided with teeth for engaging said apertures, said lower magnetic pads being provided with nibs engageable with some of the apertures, whereby said lower magnetic pads may be adjustably positioned with respect to said belt.

6. A device according to claim 1, wherein said endless belt has a pair of spaced opposite runs, one of said lower magnetic pads being secured on the inside of one of said runs, and the other lower magnetic pads being secured on the inside of the other of said runs.

* * * * *